US012305288B2

(12) United States Patent
Takahashi

(10) Patent No.: US 12,305,288 B2
(45) Date of Patent: May 20, 2025

(54) COATING AGENT FOR FORMING GRAIN-ORIENTED ELECTRICAL STEEL SHEET COATING AND METHOD FOR MANUFACTURING GRAIN-ORIENTED ELECTRICAL STEEL SHEET

(71) Applicant: NIPPON STEEL CORPORATION, Tokyo (JP)

(72) Inventor: Fumiaki Takahashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 904 days.

(21) Appl. No.: 17/434,983

(22) PCT Filed: Mar. 25, 2020

(86) PCT No.: PCT/JP2020/013426

§ 371 (c)(1),
(2) Date: Aug. 30, 2021

(87) PCT Pub. No.: WO2020/196657

PCT Pub. Date: Oct. 1, 2020

(65) Prior Publication Data

US 2022/0145472 A1 May 12, 2022

(30) Foreign Application Priority Data

Mar. 25, 2019 (JP) ..... 2019-056722

(51) Int. Cl.
*C23C 22/50* (2006.01)
*C23C 22/46* (2006.01)

(52) U.S. Cl.
CPC ..... *C23C 22/50* (2013.01); *C23C 22/46* (2013.01)

(58) Field of Classification Search
None
See application file for complete search history.

(56) References Cited

U.S. PATENT DOCUMENTS 3,856,508 A 12/1974 Tanaka et al.

FOREIGN PATENT DOCUMENTS

| | | | |
|---|---|---|---|
| JP | 48-39338 | A | 6/1973 |
| JP | 58-26405 | A | 2/1983 |
| JP | 62-86175 | A | 4/1987 |
| JP | 6-65754 | A | 3/1994 |
| JP | 7-228977 | A | 8/1995 |
| JP | 7-278828 | A | 10/1995 |
| JP | 7-278832 | A | 10/1995 |
| JP | 9-235679 | A | 9/1997 |
| JP | 9-263951 | A | 10/1997 |
| JP | 9-272983 | A | 10/1997 |
| JP | 3379027 | B2 | 2/2003 |
| JP | 2010013692 | A * | 1/2010 |

OTHER PUBLICATIONS

Machine Translation of JP 2010013692 (Year: 2010).*

* cited by examiner

*Primary Examiner* — Michael Forrest
(74) *Attorney, Agent, or Firm* — Birch, Stewart, Kolasch & Birch, LLP

(57) ABSTRACT

A coating agent for forming a grain-oriented electrical steel sheet coating able to form an aluminum borate coating high in adhesion and large in tension and a method for manufacturing the grain-oriented electrical steel sheet are provided. The coating agent for forming a grain-oriented electrical steel sheet coating of the present invention comprises an aluminum source containing aluminum oxide and/or an aluminum oxide precursor compound, a boron source containing a borate of an alkali metal, and silicon oxide and/or a silicon oxide precursor in an amount, converted to silicon oxide, of 5 mass % or more and 10 mass % or less with respect to a total solids concentration of the aluminum source and boron source, the aluminum source and the boron source contained so that, by molar ratio, Al/B: 0.5 to 2.0, a solids concentration of a total of the aluminum source and the boron source being 20 mass % or more and 38 mass % or less, and pH being 2.0 or more and 6.0 or less.

11 Claims, No Drawings

COATING AGENT FOR FORMING GRAIN-ORIENTED ELECTRICAL STEEL SHEET COATING AND METHOD FOR MANUFACTURING GRAIN-ORIENTED ELECTRICAL STEEL SHEET

FIELD

The present invention relates to a coating agent for forming a grain-oriented electrical steel sheet coating and a method for manufacturing grain-oriented electrical steel sheet.

BACKGROUND

Grain-oriented electrical steel sheet has a texture having {110}<001> as its main orientation and is extensively used as a material for cores of transformers. In particular, a material with a small iron loss is required so as to reduce energy loss.

In PTL 1, as a means for reducing the iron loss of grain-oriented electrical steel sheet, the method of laser beam radiation over a surface of steel sheet after batch annealing to impart local strain and thereby subdivide the magnetic domains is disclosed.

In PTL 2, a means for subdividing the magnetic domains where this effect is not lost even after stress relief annealing after working the cores (stress relieving annealing) is disclosed.

On the other hand, an iron alloy containing iron and silicon has a large magnetic anisotropy, so if imparting external tension, subdivision of the magnetic domains occurs and the eddy current loss, the main element in iron loss, is made to decrease. In particular, to reduce the iron loss of grain-oriented electrical steel sheet containing 5% or less of silicon, it is known to be effective to impart tension to the steel sheet. This tension is imparted by the coating formed on the surface.

Grain-oriented electrical steel sheet is given tension of about 10 MPa in the case of a thickness of 0.23 mm by two layers of coatings: a primary coating comprised of mainly forsterite formed by a reaction of oxides on the surface of the steel sheet and an annealing separator in the batch annealing process and a secondary coating comprised of mainly amorphous solids formed by annealing a coating solution comprised of mainly colloidal silica and a phosphate disclosed in PTL 3 etc.

In the case of the above such conventional coating, while it is possible to increase the coating weight to impart a further larger tension and the possibility remains of improvement of iron loss by increase of tension, making the coating thicker than the present so as to increase the tension imparted is not preferable since it causes a decrease in the lamination factor. For this reason, a coating excellent in adhesion and able to impart a large tension to steel sheet thinly without causing a decrease in the lamination factor has been desired.

As opposed to this, in PTL 4, grain-oriented electrical steel sheet having a coating mainly comprised of aluminum borate crystals on its surface has been proposed.

In order for a certain coating to become a high tension coating, a high Young's modulus and a small coefficient of thermal expansion of the coating are required. In general, crystals are higher in Young's modulus than amorphous solids. A coating comprised of aluminum borate is higher in Young's modulus than a conventional amorphous coating comprised of silica and a phosphate since the main constituent is crystalline. A coating comprised of aluminum borate is also sufficiently low in coefficient of thermal expansion, so together with the effect of the Young's modulus, can give a higher tension than a coating such as disclosed in PTL 3.

However, in the art of PTL 4, the solids concentration of the coating solution for forming the coating is low, so there was the problem that bubbling occurred at the time of drying and annealing on the coating and coating defects were formed.

To prevent such coating defects, in PTL 5, it is disclosed that it is necessary to raise the concentration of an aluminum oxide precursor so as to raise the solids concentration. A method combining the three conditions of addition, strong stirring, and warming of a glue to stabilize the viscosity of the coating solution becoming a problem at that time is described. Note that if raising the concentration of boric acid, gelling is caused, so it is shown that increasing the amount of boric acid is not preferable. In PTL 6, a coating agent for forming grain-oriented electrical steel sheet containing compounds forming boron and aluminum sources, an organic solvent having compatibility with water, and water is disclosed. Further, in PTL 7, a method using a particulate dispersion with a high solids concentration as the coating solution for the purpose of raising the rate of temperature rise at the time of drying the coating solution is disclosed. That is, this method is a method of using a particulate dispersion using 12 to 26 wt % of soluble boric acid converted to boron oxide and raising the temperature in the temperature region where boric acid precipitates by a relatively fast rate so as to inhibit the formation of coarse boric acid crystals at the time of drying after coating the dispersion. However, boric acid is soluble in water if in a concentration of its solubility or less, but with the method of PTL 7, a solution containing boric acid in a concentration above its solubility is used, so unavoidably undissolved boric acid is present in the particulate dispersion. If undissolved boric acid is present in the particulate dispersion, the undissolved boric acid will easily settle, so it will become difficult to maintain a state where the coating solution is uniformly mixed and as a result obtaining a high tension coating will become difficult. A coating solution which easily settles is an unstable coating solution. Inconveniences arise when using this for production.

CITATIONS LIST

Patent Literature

[PTL 1] Japanese Unexamined Patent Publication No. 58-26405

[PTL 2] Japanese Unexamined Patent Publication No. 62-86175

[PTL 3] Japanese Unexamined Patent Publication No. 48-39338

[PTL 4] Japanese Unexamined Patent Publication No. 6-65754

[PTL 5] Japanese Unexamined Patent Publication No. 9-263951

[PTL 6] Japanese Unexamined Patent Publication No. 7-278828

[PTL 7] Japanese Unexamined Patent Publication No. 9-272983

SUMMARY

Technical Problem as mentioned above, a coating comprised of aluminum borate is sufficiently low in coefficient of thermal expansion, so can give a higher tension than a conventional amorphous coating comprised of silica and a phosphate. However, a coating agent for forming an aluminum borate coating had the weak point of being low in solids concentration. Specifically, the solids concentration in a conventional coating agent of a tension coating comprised of a phosphate and amorphous silica is 20 mass % or so, but with a coating agent for forming an aluminum borate coating, raising the solids concentration to 10 mass % or so was the limit.

If the solids concentration of the coating agent is low, if trying to secure the required coating thickness, the problem arises that the drying process for removing the moisture takes time. If rapidly raising the temperature so as to shorten the drying time, there was the problem that coating defects formed due to bubbling etc. If such coating defects are formed, the tension decreases and the adhesion of the coating to the base metal steel sheet decreases. The inventors studied this and clarified that to solve such a problem, it is necessary to make the solids concentration of the coating agent for forming the aluminum borate coating the same extent as a conventional coating agent of a tension coating comprised of a phosphate and amorphous silica.

In the art described in PTL 5 for raising the solids concentration of an aluminum borate coating solution, it was only possible to raise the solids concentration of the aluminum borate coating solution to approximately 19 mass % as maximum. On the other hand, in the art described in PTL 6, sometimes gas was generated derived from the organic solvent at the time of drying the coating solution. Coating defects were liable to be induced. Further, in the method in PTL 7, it was not possible to obtain a stable coating solution with a high solids concentration.

The present invention has as its object the provision of a coating agent for forming a grain-oriented electrical steel sheet able to form an aluminum borate coating high in adhesion and large in tension and a method for manufacturing the grain-oriented electrical steel sheet.

Solution to Problem

The inventors discovered that to obtain a coating solution of a solids concentration sufficient for suppressing coating defects, a high concentration boric acid solution may be used and that the problem of gelling in the high concentration boric acid solution in PTL 5 can be avoided by adjusting the pH of the coating solution. Further, they discovered that to raise the solids concentration, it is possible to use an aqueous solution of boric acid dissolved in heated water.

The present invention was made based on the above findings and has as its gist the following:

(1) A coating agent for forming a grain-oriented electrical steel sheet coating comprising
- an aluminum source containing aluminum oxide and/or an aluminum oxide precursor compound,
- a boron source containing a borate of an alkali metal, and
- silicon oxide and/or a silicon oxide precursor in an amount, converted to silicon oxide, of 5 mass % or more and 10 mass % or less with respect to a total mass of the aluminum source and boron source,
- the aluminum source and the boron source contained so that the B contained in the boron source and the Al contained in the aluminum source become, converted to molar ratio, Al/B: 0.5 to 2.0,
- solid concentration of a total of the aluminum source and the boron source being 20 mass % or more and 38 mass % or less, and
- pH being 2.0 or more and 6.0 or less.

(2) The coating agent for forming the grain-oriented electrical steel sheet coating according to (1), wherein the boron source contains boric acid.

(3) The coating agent for forming the grain-oriented electrical steel sheet coating according to (1) or (2), wherein the alkali metal contains at least one of sodium and potassium.

(4) The coating agent for forming the grain-oriented electrical steel sheet coating according to any one of (1) to (3), further containing one or more types of inorganic acids selected from the group comprising nitric acid and hydrochloric acid and/or one or more types of organic acids selected from the group comprising acetic acid, citric acid, and oxalic acid.

(5) A method for manufacturing grain-oriented electrical steel sheet having a process of forming an aluminum borate coating using a coating agent for forming the grain-oriented electrical steel sheet coating according to any one of (1) to (4).

Advantageous Effects of Invention

As mentioned above, according to the present invention, it is possible to provide a coating agent for forming a grain-oriented electrical steel sheet coating able to form an aluminum borate coating high in adhesion and large in tension and a method for manufacturing the grain-oriented electrical steel sheet.

DESCRIPTION OF EMBODIMENT

Below, the present invention will be mentioned in detail based on a preferred embodiment of the present invention.

1. Coating Agent for Forming Grain-Oriented Electrical Steel Sheet Coating

First, a coating agent for forming the grain-oriented electrical steel sheet coating according to the present embodiment (below, also simply called "the coating agent") will be mentioned.

Investigation of Inventors

First, before explaining the constituents of the coating agent for forming the grain-oriented electrical steel sheet coating according to the present embodiment, the studies of the inventors leading to the present invention will be mentioned.

The inventors first thought to increase the solids concentration in the coating agent by using a borate of an alkali metal having a high solubility in water. However, as mentioned above, the inventors were confronted with the two problems that if increasing the concentration of boric acid in the coating agent, the coating agent would gel and the adhesion would decrease.

First, regarding the first problem of the gelling of the coating agent, it was surmised that this occurred due to the alkali borate of an alkali metal being added to the acid-stable alumina sol or other aluminum source and the environment of the alumina sol or other aluminum source changing to a neutral side. If the coating agent gels before coating, a normal coating cannot be formed, so it is necessary to avoid this. To avoid gelling due to the above such reasons, it is sufficient to maintain the environment of dispersion or dissolution of the alumina sol or other aluminum source at the acidic side. The inventors discovered that this can be solved by adding an acid to the coating agent.

Next, regarding the second problem of the deterioration of the adhesion, it was guessed that this occurred due to addition of the alkali metal to the aluminum borate coating. This is believed to have occurred due to splitting of glassy network believed to be present in the aluminum borate coating in addition to the aluminum borate crystal substance. The inventors surmised that this glassy substance was comprised of boric acid glass formed by the boron contained in excess in the coating agent.

The composition of the aluminum and boron in the coating agent can be designed so that the amount of boron becomes larger than the stoichiometric composition of the aluminum borate crystals. If increasing the amount of boron, the effect of improvement of the tension and the effect of improvement of the adhesion are secured. In this case, the inventors surmised that the excess boron formed a glassy substance in the aluminum borate coating and contributed to securing adhesion of the coating and the steel sheet.

If potassium or another monovalent metal element is contained in this glassy substance, the network structure of the glass is destroyed and as a result it is believed that the adhesion of the aluminum borate coating is impaired. The inventors thought that such a mechanism degrading the adhesion was in action and tried to solve the problem by supplementing the glass forming elements. They studied various means for solving this and as a result discovered that by optimizing the ratio of the aluminum and boron in the coating solution and adding silicon oxide into the aluminum borate coating, it was possible to secure adhesion. Specifically, they discovered that by adjusting the ratio of the aluminum and boron in the coating agent to a composition with an excess of boron compared with the past and adding a suitable quantity of silicon oxide, an improvement in the adhesion could be achieved.

Therefore, the coating agent for forming the grain-oriented electrical steel sheet coating according to the present embodiment contains an aluminum source containing aluminum oxide and/or an aluminum oxide precursor compound, a boron source containing a borate of an alkali metal, silicon oxide and/or a silicon oxide precursor in 5 mass % or more and 10 mass % or less converted to silicon oxide with respect to the total mass of the aluminum source and boron source, and water, the aluminum source and the boron source contained so that the B contained in the boron source and the Al contained in the aluminum source become, by molar ratio, Al/B: 0.5 to 2.0, the total solids concentration of the aluminum source and the boron source being 20 mass % or more and 38 mass % or less, and pH being 2.0 or more and 6.0 or less.

Below, the constituents etc. contained in the coating agent will be mentioned in detail.

Aluminum Source

The aluminum source of the coating agent contains aluminum oxide and/or an aluminum oxide precursor compound. The aluminum oxide precursor compound is not particularly limited so long as able to form aluminum oxide in the aluminum borate coating formed. For example, a hydrate of aluminum oxide expressed by $Al_2O_3 \cdot mH_2O$ such as boehmite, aluminum hydroxide, etc. may be mentioned. Among these, single types alone or two or more types in combination may be used.

The aluminum source may be dispersed in the coating agent, but it may also be dissolved in the coating agent. Normally, the aluminum source is dispersed in the coating agent. The aluminum source is preferably particle-like in form so as to stably disperse in the coating agent. In this case, the average particle size (D50) based on the volume of the aluminum source by the laser diffraction scattering method is, for example, 0.005 μm or more and 1.0 μm or less, preferably 0.015 μm or more and 0.7 μm or less.

Further, the aluminum source may be added to the coating agent in the form of a sol. By using a particulate dispersion called a sol, a thin, uniform, and good adhesion aluminum borate coating is obtained. As such a sol, for example, alumina sol, boehmite sol, etc. may be mentioned. Boehmite sol and alumina sol are particularly suitable from the viewpoints of work efficiency or price etc.

Further, the content of the aluminum source in the coating agent is not particularly limited so long as able to satisfy the later mentioned solids concentration and ratio with the boron source, but for example can be made 1 mass % or more and 25 mass % or less, preferably 2 mass % or more and 20 mass % or less.

Boron Source

The boron source of the coating agent contains a borate of an alkali metal.

A borate of an alkali metal has an extremely high solubility with respect to water or another solvent of the coating agent and enables manufacture of a coating agent with a high solids concentration.

The alkali metal is not particularly limited. Lithium, sodium, potassium, rubidium, cesium, and francium may be mentioned. Among these, one or two or more types in combination may be used. Among these, sodium and potassium have high solubility with respect to the solvent of the coating agent when made borates and, further, are advantageous from the viewpoint of manufacturing costs.

As the boric acid constituent forming the borate of an alkali metal, orthoboric acid, meta-boric acid, tetra-boric acid, or other oxoacids of boron may be mentioned. Among these, one or two or more types in combination may be used. Among these, tetra-boric acid is high in solubility with respect to the solvent of the coating agent when made a borate and can suitably contribute to increase of the solids concentration of the coating agent. Here, if trying to raise the concentration of boric acid by just boric acid without using a borate of an alkali metal, since boric acid has a low solubility with respect to water, undissolved boric acid remains in the aqueous solution. If such a boric acid aqueous solution stops being stirred, the undissolved boric acid settles resulting in a boric acid aqueous solution unstable as a boric acid source for a coating solution. Note that whether a boric acid aqueous solution is unstable can be easily judged by the presence of any sediment in the aqueous solution since boric acid settles if stirring is stopped. The coating agent according to the present embodiment can be made an aqueous solution with no undissolved boric acid present.

As specific examples of preferable combinations of borates of an alkali metal, sodium tetraborate, potassium tetraborate, lithium tetraborate, etc. may be mentioned. In particular, due to the high solubility with respect to water, the borate of an alkali metal preferably contains sodium tetraborate and potassium tetraborate, more preferably potassium tetraborate.

Further, as the boron source, in addition to the above-mentioned borate of an alkali metal, other boron sources can be used in a range enabling the later-mentioned solids concentration to be maintained. As such other boron sources, orthoboric acid, meta-boric acid, tetra-boric acid, or other oxoacid of boron (boric acid), boron oxide represented by $B_2O_3$, etc. may be mentioned. Among these, single types alone or two or more types in combination may be used. Among these, orthoboric acid represented as $H_3BO_3$ is preferable from the viewpoint of work efficiency and costs.

Further, the content of the boron source in the coating agent is not particularly limited so long as able to satisfy the later mentioned solids concentration and ratio with the aluminum source, but for example it may be 5 mass % or more and 30 mass % or less. In particular, as the method for raising the solids content of the sodium borate aqueous solution, the method is known of mixing boric acid and sodium tetra-borate in a weight ratio of 1:1.25, making them completely dissolve in 80° C. or more water, then cooling down to room temperature (25±15° C.) to obtain a sodium poly-borate aqueous solution. If using this method, it is possible to obtain an aqueous solution containing a boron source with a higher solids concentration than the case of mixing these at room temperature.

Here, as mentioned above, the coating agent according to the present embodiment contains a larger amount of the boron source than the aluminum source compared with the past. Specifically, the coating agent contains the aluminum source and the boron source to give a molar ratio Al/B of 0.5 to 2.0. Due to this, a glassy network is sufficiently formed in the aluminum borate coating which is formed and the adhesion is improved. Here, if the boron source is too small, there is no effect of improvement of the adhesion. On the other hand, if the boron source is too large, the tension decreases and the waterproofness of the aluminum borate coating deteriorates causing rust to form.

Note that, by satisfying the above-mentioned molar ratio of the aluminum source and the boron source, the adhesion of the aluminum borate coating is improved, but with just satisfying the molar ratio, the adhesion is not sufficiently improved. As mentioned later, the adhesion of the aluminum borate coating is sufficiently improved by containing silicon oxide and/or a silicon oxide precursor in the coating agent.

Further, the total solids concentration of the aluminum source and the boron source in the coating agent is 20 mass % or more and 38 mass % or less. Here, the "solids concentration" is the concentration of the total mass of the aluminum source and the boron source in the coating agent. The aluminum source is evaluated converted to aluminum oxide ($Al_2O_3$), while the boron source is evaluated converted to orthoboric acid ($H_3BO_3$). The solids concentration is the weight percent of the weights of the aluminum oxide and orthoboric acid in the overall amount of these plus the weights of the solvent and acids. The coating agent according to the present embodiment can achieve the above such solids concentration by containing a borate of an alkali metal as a boron source and containing a predetermined amount of acid mentioned later. By the total solids concentration of the aluminum source and the boron source being large in this way, it is possible to form an aluminum borate coating which is high in adhesion and large in tension. Further, in the coating agent according to the present embodiment, the gelling of the coating agent and the decrease in the adhesion which were conventional problems are also prevented.

If the total solids concentration of the aluminum source and the boron source is less than 20 mass %, the solids concentration becomes lower. As a result, if trying to secure the required coating thickness, excessive time is required for the process of removing the solvent (drying process). If rapidly raising the temperature to shorten the drying time, bubbling etc. causes coating defects to end up being formed. The above solids concentration is preferably 25 mass % or more.

If the total solids concentration of the aluminum source and the boron source is over 38 mass %, the coating solution becomes easier to gel and becomes unstable. The above solids concentration is preferably 35 mass % or less.

Silicon Oxide and Silicon Oxide Precursor

Further, the coating agent contains silicon oxide and/or a silicon oxide precursor. The silicon oxide and/or silicon oxide precursor contributes to formation of a glassy network in the aluminum borate coating and contributes to improvement of the adhesion of the obtained aluminum borate coating.

The silicon oxide is not particularly limited. Various types of known silicon oxide can be used. In particular, colloidal silica is excellent in dispersion in the coating agent.

Further, as the silicon oxide precursor, a compound able to form silicon oxide, for example, a silane compound, may be mentioned. The silane compound is not particularly limited, but, for example, tetraethoxysilane or other alkoxysilane or another silicon oxide precursor etc. may be mentioned. Among these, single types alone or two or more types in combination may be used. Alternatively, partially hydrolyzed products of these silane compounds may also be used.

Further, the total content of the silicon oxide and silicon oxide precursor in the coating agent is 5 mass % or more and 10 mass % or less converted to silicon oxide with respect to the total mass of the aluminum source and the boron source. Due to this, it is possible to simultaneously make the adhesion and tension of the obtained aluminum borate coating excellent.

As opposed to this, if the total content of the silicon oxide and silicon oxide precursor is less than the above lower limit value, the adhesion of the obtained aluminum borate coating becomes inferior. The total content of the silicon oxide and silicon oxide precursor is preferably 6 mass % or more converted to silicon oxide with respect to the total mass of the aluminum source and the boron source.

Further, if the total content of the silicon oxide and silicon oxide precursor is over the above upper limit value, there is an effect on the formation of aluminum borate and as a result the tension of the obtained aluminum borate coating becomes inferior. The total content of the silicon oxide and silicon oxide precursor is preferably 8 mass % or less converted to silicon oxide with respect to the total mass of the aluminum source and the boron source.

Further, with just containing silicon oxide and/or a silicon oxide precursor, the adhesion of the aluminum borate coating is not sufficiently improved. It is only after satisfying the molar ratio of the aluminum source and boron source such as mentioned above and further containing silicon oxide and/or a silicon oxide precursor that the adhesion of the aluminum borate coating becomes sufficient.

Acid

The coating agent contains an ordinary acid. Here, in this Description, the "acid" means an acid defined in the Brønsted-Lowry acid-base theory and means a substance donating protons. By the coating agent containing such an acid, the pH of the coating agent can be adjusted to the later mentioned range, the dispersion stability and solubility of the aluminum source in the coating agent are improved, and gelling of the coating agent is prevented.

As such an acid, nitric acid, hydrochloric acid, or other inorganic acids and acetic acid, citric acid, oxalic acid, and other organic acids may be mentioned. Among these, one or two or more types in combination may be used. Among these, as the acid, one which is degraded or vaporized at the formation of the aluminum borate coating, for example, during heating, is preferable.

As such an acid which is degraded or vaporized, one or more types of inorganic acids and/or organic acids selected from the group comprised of nitric acid and hydrochloric acid or one or more types of organic acids selected from the group comprised of acetic acid, citric acid, and oxalic acid may be mentioned. Therefore, the coating agent preferably contains one or more types of acids selected from these.

The content of the acid in the coating solution is not particularly limited so long as enabling the pH of the coating agent to be maintained in a suitable range (2.0 or more and 6.0 or less) and can be suitably adjusted in accordance with the targeted pH.

Solvent

Further, the coating agent includes a solvent. The solvent functions as a solvent dissolving the constituents and functions as a dispersant causing the constituents to disperse.

The above such solvent is not particularly limited, but water or an alcohol, ketone, ether, hydrocarbon, etc. may be mentioned. Among these, one or two or more types in combination can be used.

In particular, as the solvent, water is preferable from the viewpoint of work efficiency and the effect of suppression of defects at the time of drying and also the excellent dispersion and solubility of the different constituents.

Above, the pH of the coating agent is 2.0 or more and 6.0 or less. If the pH of the coating agent is in the above range, the aluminum source can be stably dispersed and dissolved.

As opposed to this, if the pH in the coating agent is over the above upper limit value, the dispersion stability and solubility of the aluminum source cannot be improved and the coating agent ends up gelling. As a result, when coating and drying the coating agent on the steel sheet, cracks and voids frequently occur in the aluminum borate coating and other fine coating defects are formed making it impossible to obtain a sound coating and as a result sufficient tension can no longer be obtained. The pH of the coating agent is preferably 5.0 or less.

On the other hand, if the pH in the coating agent is less than the above lower limit value, conversely the coating solution becomes unstable. As a result, when coating and drying the coating agent on the steel sheet, cracks and voids frequently occur in the aluminum borate coating and other fine coating defects are formed making it impossible to obtain a sound coating and as a result sufficient tension can no longer be obtained. The pH of the coating agent is preferably 3.0 or more.

Note that, the above-mentioned pH can, for example, be realized by addition of an acid. As one example, it can be realized by addition of a solution of an acid with pH of 2.0 or less in 5.0 mass % or more and 10.0 mass % or less.

According to the coating agent according to the present embodiment mentioned above, it is possible to prevent gelling of the coating agent and the decrease in adhesion of the aluminum borate coating while increasing the solids concentration of the boron source and the aluminum source. For this reason, when forming an aluminum borate coating of a sufficient coating thickness, the time required for drying after coating the coating agent on the steel sheet is greatly shortened. Further, it is possible to ease the temperature at the time of drying and other drying conditions and possible to keep coating defects from being formed. As a result, when using the coating agent according to the present embodiment, it is possible to form an aluminum borate coating high in adhesion and large in tension.

2. Method for Manufacturing Grain-Oriented Electrical Steel Sheet

Below, a method for manufacturing the grain-oriented electrical steel sheet according to the present embodiment will be mentioned. The method for manufacturing the grain-oriented electrical steel sheet according to the present embodiment includes a process of using the above-mentioned coating agent for forming the grain-oriented electrical steel sheet coating according to the present embodiment to form an aluminum borate coating.

Preparation of Coating Agent for Forming Grain-Oriented Electrical Steel Sheet Coating First, before the above-mentioned process, the coating agent for forming the grain-oriented electrical steel sheet coating (coating agent) is prepared. The method for manufacturing the coating agent is not particularly limited, but for example the coating agent can be obtained by mixing the materials forming it. The order of mixing the materials is not particularly limited and can be suitably set in accordance with work efficiency or the dispersibility and solubility of the materials.

Preparation of Base Metal Steel Sheet

Next, the base metal steel sheet for formation of the aluminum borate coating is prepared. As the base metal steel sheet, specifically, (1) steel sheet batch annealed by a conventionally known method and formed with a forsterite-based primary coating on its surface, (2) steel sheet from which the primary coating and ancillary formed internal oxide layer are removed by pickling, (3) steel sheet obtained by heat flattening the steel sheet obtained in the above (2) in a hydrogen-containing atmosphere or steel sheet chemically or electrolytically polished or otherwise polished, (4) steel sheet coated with a conventionally known annealing separator to which alumina powder inert to formation of a coating or chlorides or other trace additives are added and batch annealed under conditions not allowing formation of a primary coating steel sheet or steel sheet flattened on its surface by a method such as (3), or other steel sheet on which batch annealing has been completed may be prepared. Note that, the base metal steel sheet may be prepared before or after preparing the above-mentioned coating agent.

Formation of Aluminum Borate Coating

Next, the prepared coating agent is used to form an aluminum borate coating on the surface of the steel sheet. The aluminum borate coating can be formed by coating the coating agent on the surface of the steel sheet, then drying and annealing it.

The surface of the steel sheet can be coated by, for example, a roll coater or other coater, dipping, spraying, or electrophoresis or another conventionally known method.

The steel sheet after coating the coating agent is dried, then annealed whereby an aluminum borate coating is formed on the surface of the steel sheet. The annealing can be performed at a temperature of, for example, 750° C. or more. If the annealing temperature is less than 750° C., the coated precursor will sometimes not form oxides. Further, since the annealing temperature is low, sufficient tension is not obtained so this is not preferable. The annealing temperature is preferably 750° C. or more and 1200° C. or less, more preferably 800° C. or more and 1000° C. or less.

The atmosphere at annealing is preferably nitrogen or another inert gas atmosphere, a nitrogen-hydrogen mixed atmosphere, or other reducing atmosphere. Air or an atmosphere excessively containing oxygen may cause excessive oxidation of the steel sheet and is not preferable.

Regarding the dew point of the atmospheric gas, good results were obtained at 0 to 40° C.

By the above, grain-oriented electrical steel sheet with an aluminum borate coating having a high adhesion and tension can be manufactured.

EXAMPLES

Below, the present invention will be mentioned in detail based on examples, but the examples shown below are in the end merely illustrations of the present invention. The present invention is not limited to only these examples.

Example 1

Commercially available boric acid (orthoboric acid), potassium tetraborate, or sodium tetraborate, aluminum oxide ($Al_2O_3$) powder (average particle size: 0.4 μm), a 0.5M nitric acid aqueous solution, and silicon oxide were mixed in the ratios shown in Table 1. Note that the pH of the nitric acid was 0.5. Slurries used as the coating agents according to Examples 1-1 to 1-6 and Comparative Examples 1-1 to 1-7 were prepared at room temperature as mentioned above. Note that, as the solvent, water was used. On the other hand, the coating solution of Example 1-6 was prepared by preparing high concentration polyboric acid in the following way. First, 700 g of water was heated to 80° C., the amounts of boric acid and sodium tetraborate in Example 1-6 were added, and the result was stirred while maintaining the temperature until these completely dissolved. After they completely dissolved, the solution was gradually cooled down to room temperature (30° C.) to prepare the high concentration polyboric acid solution. To this, aluminum oxide powder, 0.5M nitric acid aqueous solution, and silicon oxide were added in the amounts in Table 1 and the mixture sufficiently stirred.

The prepared coating agents were measured for viscosity and pH. The viscosity was measured using a B-type viscometer for a 30° C. coating agent. The pH was measured for a 30° C. coating agent using a pH meter. The results are shown in Table 1.

The prepared coating agent was allowed to stand without stirring for 30 minutes. After that, it was coated on grain oriented silicon steel sheet containing Si in 3.2 mass %, having a thickness of 0.23 mm, and finished being batch annealed (with a forsterite primary coating) to give a weight of coating after annealing of 4.5 g/m$^2$. This was dried and annealed at 850° C. for 60 seconds. Here, the atmosphere when drying and annealing was made a nitrogen atmosphere containing hydrogen in 10 vol % and the dew point was made 30° C. Due to the above, grain-oriented electrical steel sheets having an aluminum borate coating according to Examples 1-1 to 1-6 and Comparative Examples 1-1 to 1-7 were obtained.

The obtained grain-oriented electrical steel sheets were evaluated for adhesion of the aluminum borate coating and coating tension.

For the adhesion of the aluminum borate coating, the adhesion of a sample when the sheet was wound around a φ20 mm cylinder and there was no peeling of the coating was evaluated as good and otherwise was evaluated as poor.

For measurement of the coating tension, the coating on one side of a steel sheet formed with a aluminum borate coating was removed and the tension was calculated from the curvature of the steel sheet. The coating was removed using a sodium hydroxide aqueous solution. A sample with a coating tension of 12 MPa or more was evaluated as good while a case not satisfying this was evaluated as poor.

The above results are shown in Table 1.

As shown in Table 1, in the coating agents according to Examples 1-1 to 1-6, the target solids concentrations (concentration of total mass of aluminum source and boron source in coating agent) were obtained. In the grain-oriented electrical steel sheets according to Examples 1-1 to 1-6 manufactured using the same, it can be understood that aluminum borate coatings excellent in adhesion and high in tension were formed.

Steel sheets manufactured using the coating agents according to Comparative Examples 1-1 and 1-2 not achieving the target solids concentration were low in coating tension. This was guessed to be because coating defects formed due to bubbling etc. at the time of drying the coating agent. On the other hand, Comparative Example 1-7 not containing an alkali metal had a high solids concentration of 30%, but was not sufficient in tension. This was guessed to be because it was a composition not containing a borate of an alkali metal, so the charged boric acid exceeded the solubility, so the boric acid remained precipitated, the solution became unstable in uniformity, and the precipitated boric acid settled while stopping stirring for 30 minutes resulting in the coating of the intended composition not being able to be obtained.

TABLE 1

| | Coating agent | | | | | | | | |
|---|---|---|---|---|---|---|---|---|---|
| | Mixed substances and amounts of mixture | | | | | | | | Concentration of total weight of aluminum source and boron source in coating agent (wt %) |
| | Aluminum source | Boron source | | | Acid | | | | |
| | Aluminum oxide (g) | Boric acid (g) | Potassium tetraborate tetrahydrate (g) | Sodium tetraborate decahydrate (g) | (0.5M nitric acid aqueous solution) (g) | Boron oxide (g) | Solvent Water (g) | Al/B molar ratio | |
| Ex. 1-1 | 100 | 95 | 182 | 0 | 177 | 24 | 1193 | 0.5 | 20 |
| Ex. 1-2 | 100 | 0 | 232 | 85 | 282 | 24 | 1088 | 0.5 | 20 |
| Ex. 1-3 | 100 | 0 | 300 | 0 | 268 | 24 | 613 | 0.5 | 28 |
| Ex. 1-4 | 96 | 0 | 72 | 0 | 73 | 11 | 179 | 2.0 | 38 |
| Comp. Ex. 1-1 | 100 | 0 | 75 | 0 | 144 | 11 | 843 | 2.0 | 14 |
| Comp. Ex. 1-2 | 100 | 0 | 300 | 0 | 300 | 24 | 1804 | 0.5 | 14 |
| Comp. Ex. 1-3 | 100 | 0 | 375 | 0 | 345 | 28 | 596 | 04 | 30 |
| Comp. Ex. 1-4 | 100 | 0 | 68 | 0 | 68 | 11 | 220 | 27 | 35 |
| Ex. 1-5 | 100 | 0 | 300 | 0 | 234 | 17 | 605 | 0.5 | 29 |
| Ex. 1-6 | 100 | 133 | 0 | 169 | 234 | 34 | 565 | 0.5 | 30 |
| Comp. Ex. 1-5 | 100 | 0 | 300 | 0 | 232 | 10 | 606 | 0.5 | 29 |
| Comp. Ex. 1-6 | 100 | 0 | 300 | 0 | 241 | 51 | 598 | 0.5 | 29 |
| Comp. Ex. 1-7 | 100 | 61 | 0 | 0 | 0 | 0 | 375 | 2.0 | 30 |

TABLE 1-continued

| | Coating agent Ratio of silicon oxide to total weight of aluminum source and boron source (wt %) | Properties: Properties of coating agent: Viscosity (mPa · s) | pH | Aluminum borate coating: Coating tension | Adhesion |
|---|---|---|---|---|---|
| Ex. 1-1 | 7 | 60 | 4.3 | Good | Good |
| Ex. 1-2 | 7 | 30 | 4.1 | Good | Good |
| Ex. 1-3 | 7 | 30 | 4.3 | Good | Good |
| Ex. 1-4 | 7 | 50 | 3.4 | Good | Good |
| Comp. Ex. 1-1 | 7 | 100 | 6.5 | Poor | Poor |
| Comp. Ex. 1-2 | 7 | 100 | 6.7 | Poor | Poor |
| Comp. Ex. 1-3 | 7 | 30 | 4.2 | Poor | Poor |
| Comp. Ex. 1-4 | 7 | 40 | 4.0 | Poor | Poor |
| Ex. 1-5 | 5 | 30 | 4.4 | Good | Good |
| Ex. 1-6 | 10 | 30 | 4.0 | Good | Good |
| Comp. Ex. 1-5 | 3 | 40 | 4.5 | Poor | Poor |
| Comp. Ex. 1-6 | 15 | 50 | 4.2 | Poor | Poor |
| Comp. Ex. 1-7 | 0 | 20 | 3.1 | Poor | Good |

Example 2

Aqueous solutions of various acids comprised of commercially available boric acid (orthoboric acid), potassium tetraborate, aluminum oxide ($Al_2O_3$) powder (average particle size: 0.4 μm), silicon oxide, and nitric acid (0.1M, pH 1.0), hydrochloric acid (0.1M, pH 0.9), acetic acid (0.5M, pH 1.9), citric acid (0.2M, pH 2.0), and oxalic acid (0.1M, pH 1.5) were mixed in the ratios shown in Table 2 to prepare slurries as the coating agents of Examples 2-1 to 2-5 and Comparative Examples 2-1 to 2-2. Note that, as the solvent, water was used.

The prepared coating agents were measured for viscosity and pH. The viscosity was measured using a B-type viscometer for a 30° C. coating agent. The pH was measured for a 30° C. coating agent using a pH meter. The results are shown in Table 2.

The prepared coating agents were coated on oriented silicon steel sheets containing Si in 3.2 mass %, having a thickness of 0.23 mm, and finished being batch annealed (with a forsterite primary coating) to give weights of coating after annealing of 4.5 g/m$^2$. These were dried and annealed at 850° C. for 60 seconds. Here, the atmosphere when drying and annealing was made a nitrogen atmosphere containing hydrogen in 10 vol % and the dew point was made 30° C. Due to the above, grain-oriented electrical steel sheets having an aluminum borate coating according to Examples 2-1 to 2-5 and Comparative Examples 2-1 to 2-2 were obtained.

The obtained grain-oriented electrical steel sheets were evaluated for adhesion of the aluminum borate coating and tension of the coating.

For the adhesion of the aluminum borate coating, the adhesion of a sample when the sheet was wound around a φ20 mm cylinder and there was no peeling of the coating was evaluated as good and otherwise was evaluated as poor.

For measurement of the coating tension, the coating on one side of a steel sheet formed with a aluminum borate coating was removed and the tension was calculated from the curvature of the steel sheet. The coating was removed using a sodium hydroxide aqueous solution. A sample with a coating tension of 12 MPa or more was evaluated as good while a case not satisfying this was evaluated as poor.

The above results are shown in Table 2.

As shown in Table 2, in the coating agents according to Examples 2-1 to 2-5, the target solids concentrations were obtained. In the grain-oriented electrical steel sheets according to Examples 2-1 to 2-5 manufactured using the same, it can be understood that aluminum borate coatings excellent in adhesion and high in tension were formed.

TABLE 2

| | Coating agent: Composition: Aluminum source: Aluminum oxide (g) | Boron source: Boric acid (g) | Boron source: Potassium tetraborate tetrahydrate (g) | Acid (aqueous solution): Type | Acid (aqueous solution): Amount (g) | Silicon oxide (g) | Solvent: Water (g) | Al/B molar ratio |
|---|---|---|---|---|---|---|---|---|
| Ex. 2-1 | 100 | 95 | 183 | 0.1M nitric acid | 445 | 24 | 845 | 0.5 |
| Ex. 2-2 | 100 | 95 | 183 | 0.1M hydrochloric acid | 445 | 24 | 845 | 0.5 |
| Ex. 2-3 | 100 | 95 | 183 | 0.1M acetic acid | 445 | 24 | 845 | 0.5 |
| Ex. 2-4 | 100 | 95 | 183 | 0.2M citric acid | 445 | 24 | 845 | 0.5 |
| Ex. 2-5 | 100 | 95 | 183 | 0.1M oxalic acid | 445 | 24 | 845 | 0.5 |
| Comp. Ex. 2-1 | 100 | 95 | 183 | 0.1M nitric acid | 90 | 24 | 1200 | 0.5 |
| Comp. Ex. 2-2 | 100 | 95 | 183 | 0.1M nitric acid | 902 | 24 | 388 | 0.5 |

TABLE 2-continued

| | Coating agent | | Properties | | | |
|---|---|---|---|---|---|---|
| | Concentration of total weight of aluminum source and boron source in coating agent (wt %) | Ratio of silicon oxide to total weight of aluminum source and boron source (wt %) | Coating agent | | Aluminum borate coating | |
| | | | Viscosity (mPa · s) | pH | Coating tension | Adhesion |
| Ex. 2-1 | 21 | 7 | 40 | 3.2 | Good | Good |
| Ex. 2-2 | 21 | 7 | 20 | 3.1 | Good | Good |
| Ex. 2-3 | 21 | 7 | 70 | 4.2 | Good | Good |
| Ex. 2-4 | 21 | 7 | 80 | 5.0 | Good | Good |
| Ex. 2-5 | 21 | 7 | 90 | 5.2 | Good | Good |
| Comp. Ex. 2-1 | 21 | 7 | 310 | 8.0 | Poor | Poor |
| Comp. Ex. 2-2 | 21 | 7 | 5 | 1.8 | Poor | Poor |

Above, a preferred embodiment of the present invention or more was mentioned in detail, but the present invention is not limited this example. A person having ordinary knowledge in the field of art to which the present invention belongs clearly could conceive of various changes or corrections within the scope of the technical idea described in the claims. These also are understood as including in the technical scope of the present invention.

The invention claimed is:

1. A coating agent for forming a grain-oriented electrical steel sheet coating, comprising:

an aluminum source containing aluminum oxide and/or an aluminum oxide precursor compound, a boron source containing a borate of an alkali metal, and silicon oxide and/or a silicon oxide precursor in an amount, converted to silicon oxide, of 5 mass % or more and 10 mass % or less with respect to a total mass of the aluminum source and boron source, the aluminum source and the boron source contained so that the B contained in the boron source and the Al contained in the aluminum source become, converted to molar ratio, Al/B: 0.5 to 2.0, a solids concentration of a total of the aluminum source and the boron source is 20 mass % or more and 38 mass % or less, and pH is 2.0 or more and 6.0 or less.

2. The coating agent for forming the grain-oriented electrical steel sheet coating according to claim 1, wherein the boron source contains boric acid.

3. The coating agent for forming the grain-oriented electrical steel sheet coating according to claim 1, wherein the alkali metal contains at least one of sodium and potassium.

4. The coating agent for forming the grain-oriented electrical steel sheet coating according to claim 1, further containing one or more types of inorganic acids selected from the group comprising nitric acid and hydrochloric acid and/or one or more types of organic acids selected from the group comprising acetic acid, citric acid, and oxalic acid.

5. A method for manufacturing grain-oriented electrical steel sheet having a process of forming an aluminum borate coating using a coating agent for forming the grain-oriented electrical steel sheet coating according to claim 1.

6. The coating agent for forming the grain-oriented electrical steel sheet coating according to claim 2, wherein the alkali metal contains at least one of sodium and potassium.

7. The coating agent for forming the grain-oriented electrical steel sheet coating according to claim 2, further containing one or more types of inorganic acids selected from the group comprising nitric acid and hydrochloric acid and/or one or more types of organic acids selected from the group comprising acetic acid, citric acid, and oxalic acid.

8. The coating agent for forming the grain-oriented electrical steel sheet coating according to claim 3, further containing one or more types of inorganic acids selected from the group comprising nitric acid and hydrochloric acid and/or one or more types of organic acids selected from the group comprising acetic acid, citric acid, and oxalic acid.

9. A method for manufacturing grain-oriented electrical steel sheet having a process of forming an aluminum borate coating using a coating agent for forming the grain-oriented electrical steel sheet coating according to claim 2.

10. A method for manufacturing grain-oriented electrical steel sheet having a process of forming an aluminum borate coating using a coating agent for forming the grain-oriented electrical steel sheet coating according to claim 3.

11. A method for manufacturing grain-oriented electrical steel sheet having a process of forming an aluminum borate coating using a coating agent for forming the grain-oriented electrical steel sheet coating according to claim 4.

* * * * *